US007748132B1

(12) United States Patent
Engala

(10) Patent No.: US 7,748,132 B1
(45) Date of Patent: Jul. 6, 2010

(54) TILE TEE SYSTEM

(76) Inventor: Tom Engala, 1109 Rohe St., Tarpon Springs, FL (US) 34689

( * ) Notice: Subject to any disclaimer, the term of this patent is extended or adjusted under 35 U.S.C. 154(b) by 0 days.

(21) Appl. No.: 12/154,555

(22) Filed: May 23, 2008

(51) Int. Cl.
*B43L 7/10* (2006.01)

(52) U.S. Cl. ..... 33/527; 33/464

(58) Field of Classification Search ..... 33/452, 33/454, 464, 479, 526, 527
See application file for complete search history.

(56) References Cited

U.S. PATENT DOCUMENTS 826,425 A * 7/1906 Heathcote ..... 33/452
1,298,995 A * 4/1919 Michalovitz ..... 33/464
4,899,455 A 2/1990 Bovino et al.
5,361,508 A * 11/1994 Ruggiero ..... 33/527
5,617,642 A * 4/1997 Marios ..... 33/526
2003/0033724 A1 * 2/2003 Barbosa ..... 33/526
2004/0060183 A1 * 4/2004 Moas ..... 33/526
2004/0221467 A1 11/2004 Chillington
2006/0005507 A1 1/2006 Chillington et al.
2008/0052937 A1 * 3/2008 Bailey ..... 33/526

* cited by examiner

*Primary Examiner*—G. Bradley Bennett

(57) ABSTRACT

A substrate has front and rear faces, short first and second end edges, long side edges and interior and exterior side edges. First and second setting slides have front and rear faces, short end edges, long side edges and interior and exterior side edges. A measuring slide has front and rear faces, short first and second end edges and long side edges. Couplers adjustably interconnect the measuring slide to the substrate. The side edges of the measuring slide are provided parallel with the end edges of the substrate. The two setting slides are adjustably interconnected to the substrate. The side edges of the setting slides are provided parallel with the side edges of the substrate.

6 Claims, 3 Drawing Sheets

FIG 1
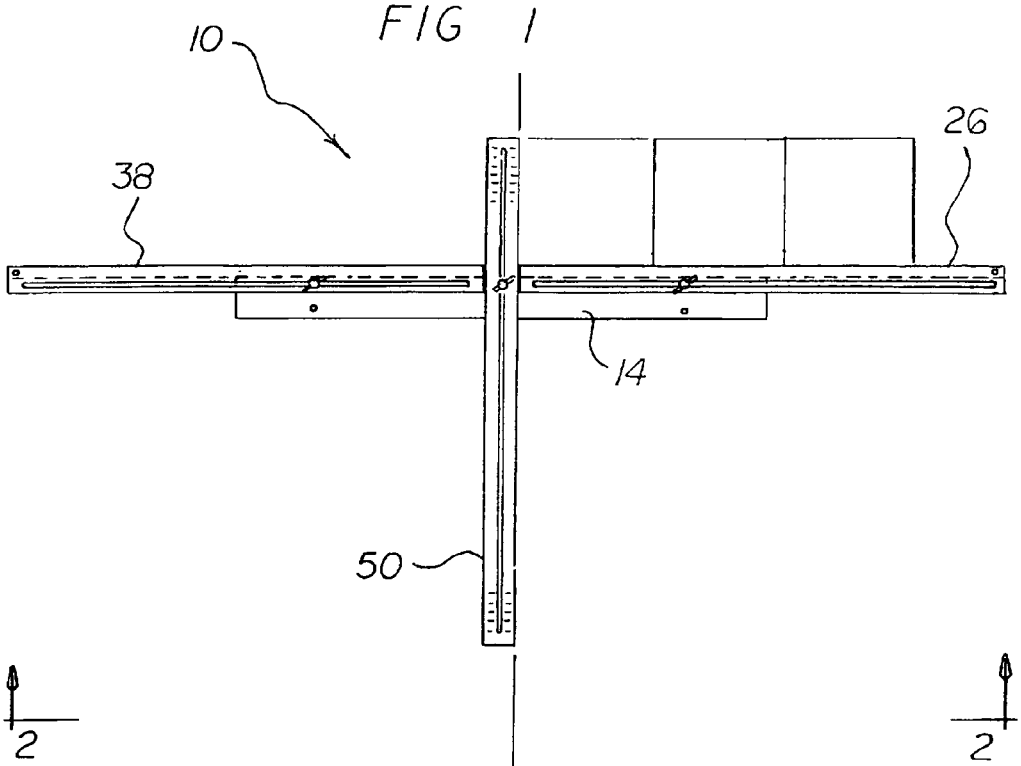
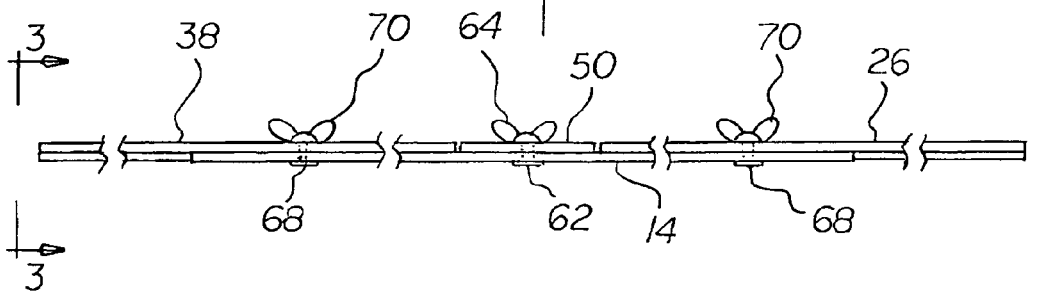
FIG 2

FIG 3
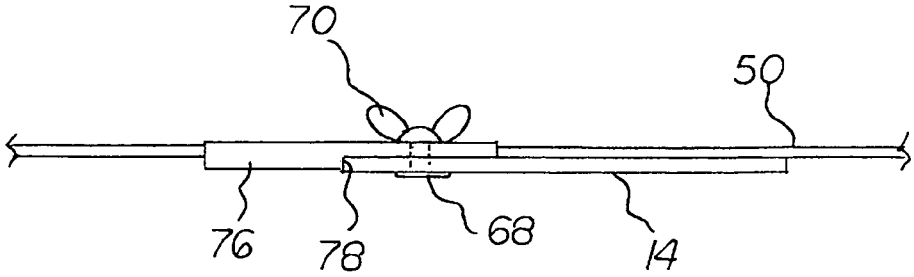
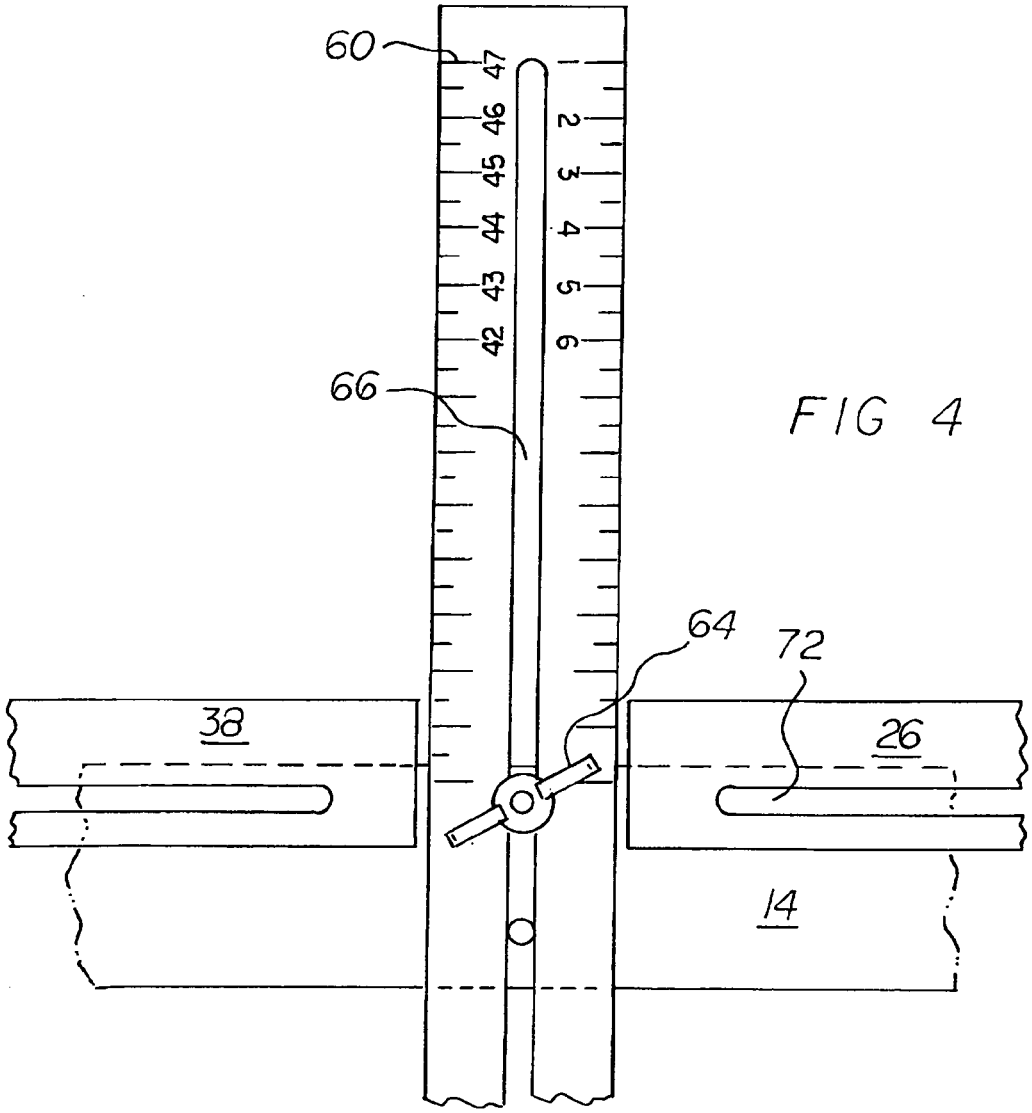
FIG 4

TILE TEE SYSTEM

BACKGROUND OF THE INVENTION

1. Field of the Invention

The present invention relates to a tile tee system and more particularly pertains to assisting craftsmen in the proper placement of tiles in linear alignment on a recipient surface in an accurate, rapid and economical manner.

2. Description of the Prior Art

The use of tools of known designs and configurations is known in the prior art. More specifically, tools of known designs and configurations previously devised and utilized for the purpose of placing tile through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,899,455 issued Feb. 13, 1990, to Bovino et al. discloses a tile squaring device. U.S. Patent Application Publication Number 2004/0221467 published Nov. 11, 2004 to Chillington discloses a tool kit for installing roofing on siding materials. Lastly, U.S. Patent Application Publication Number 2006/0005507 published Jan. 12, 2006 to Chillington et al. discloses a tool kit for installing roofing or siding materials.

While these devices fulfill their respective, particular objectives and requirements, the aforementioned patents do not describe a tile tee system that allows for assisting craftsmen in the proper placement of tiles in linear alignment on a recipient surface in an accurate, rapid and economical manner.

In this respect, the tile tee system according to the present invention substantially departs from the conventional concepts and designs of the prior art, and in doing so provides an apparatus primarily developed for the purpose of assisting craftsmen in the proper placement of tiles in linear alignment on a recipient surface in an accurate, rapid and economical manner.

Therefore, it can be appreciated that there exists a continuing need for a new and improved tile tee system which can be used for assisting craftsmen in the proper placement of tiles in linear alignment on a recipient surface in an accurate, rapid and economical manner. In this regard, the present invention substantially fulfills this need.

SUMMARY OF THE INVENTION

In view of the foregoing disadvantages inherent in the known types of tools of known designs and configurations now present in the prior art, the present invention provides an improved tile tee system. As such, the general purpose of the present invention, which will be described subsequently in greater detail, is to provide a new and improved tile tee system and method which has all the advantages of the prior art and none of the disadvantages.

To attain this, the present invention essentially comprises a tile tee system. First provided is a substrate. The substrate is in a rectilinear configuration. The substrate has front and rear faces. The substrate has short first and second end edges. The substrate has long side edges. The long side edges are provided between the end edges. The side edges include an interior side edge and an exterior side edge.

A first setting slide is provided. The first setting slide is in a rectilinear configuration. The first setting slide has front and rear faces. The first setting slide has short end edges. The first setting slide has long side edges. The long side edges are provided between the end edges. The side edges include an interior side edge and an exterior side edge. The end edges include an interior end edge and an exterior end edge.

A second setting slide is provided. The second setting slide is in a rectilinear configuration. The second setting slide has front and rear faces. The second setting slide has short end edges. The second setting slide has long side edges. The long side edges are provided between the end edges. The side edges include an interior side edge and an exterior side edge. The end edges include an interior end edge and an exterior end edge.

A measuring slide is provided. The measuring slide is in a rectilinear configuration. The measuring slide has front and rear faces. The measuring slide has short first and second end edges. The measuring slide has long side edges. The long side edges are provided between the end edges. The measuring slide has a length of 48 inches. Indicia markings are provided on the front face adjacent to both side edges.

Provided next are primary couplers. The primary couplers adjustably interconnect the measuring slide to the substrate.

The side edges of the measuring slide are provided parallel with the end edges of the substrate. The primary couplers include one central bolt. The central bolt is secured to, and extends upwardly from, the front face of the substrate. An associated central wing nut is provided. The central bolt is equally spaced from the end edges of the substrate adjacent to the exterior side edge. The primary couplers also include a primary slot. The primary slot is provided in the measuring slide. The primary slot is provided parallel with, and equally spaced from, the side edges of the measuring slide. The primary slot extends between locations adjacent to the end edges of the measuring slide. The primary bolt is adapted to receive the primary slot. The rear face of the measuring slide is provided in contact with the front face of the substrate. The wing nut on the central bolt secures the measuring slide in position.

Secondary couplers are provided. The secondary couplers adjustably interconnect the two setting slides to the substrate. The side edges of the setting slides are provided parallel with the side edges of the substrate. The secondary couplers include two end bolts. The end bolts are secured to, and extend upwardly from, the front face of the substrate. An associated end wing nut is provided. The end bolts are equally spaced from the end edges of the substrate adjacent to the exterior edge. The secondary couplers also include a secondary slot. The secondary slot is provided in each setting slide. The secondary slot is provided parallel with the side edges of the measuring slide and adjacent to its interior side edge. Each secondary slot extends between locations adjacent to its end edges of its setting slide. Each secondary bolt is adapted to receive a secondary slot. The rear face of each setting slide is provided in contact with the front face of the substrate. The wing nuts on the end bolts secure the setting slides in position. The interior end edges of the setting slides are provided in contact with the side edges of the measuring slide.

Further provided is an abutment shoulder. The abutment shoulder is provided on the back face of each setting slide beneath the exterior side edge. In this manner a planar surface is provided. The planar surface is provided in sliding contact with the exterior side edge of the substrate. Further in this manner sliding of the back faces of the setting slides on the front face of the substrate is facilitated.

Provided last are edge apertures. The edge apertures are provided through substrate adjacent to the interior edge and offset from the bolts. End apertures are provided. The end apertures are provided through the setting slides adjacent to the exterior edges in proximity to the exterior edges. The apertures are adapted to assist a user in supporting the substrate and setting slides and the measuring slide when positioning tiles on a vertical recipient surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tile tee system which has all of the advantages of the prior art tools of known designs and configurations and none of the disadvantages.

It is another object of the present invention to provide a new and improved tile tee system which may be easily and efficiently manufactured and marketed.

It is further object of the present invention to provide a new and improved tile tee system which is of durable and reliable constructions.

An even further object of the present invention is to provide a new and improved tile tee system which is susceptible of a low cost of manufacture with regard to both materials and labor, and which accordingly is then susceptible of low prices of sale to the consuming public, thereby making such tile tee system economically available to the buying public.

Even still another object of the present invention is to provide a tile tee system for assisting craftsmen in the proper placement of tiles in linear alignment on a recipient surface in an accurate, rapid and economical manner.

Lastly, it is an object of the present invention to provide a new and improved tile tee system. A substrate has front and rear faces, short first and second end edges, long side edges and interior and exterior side edges. First and second setting slides have front and rear faces, short end edges, long side edges and interior and exterior side edges. A measuring slide has front and rear faces, short first and second end edges and long side edges. Couplers adjustably interconnect the measuring slide to the substrate. The side edges of the measuring slide are provided parallel with the end edges of the substrate. The two setting slides are adjustably interconnected to the substrate. The side edges of the setting slides are provided parallel with the side edges of the substrate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a tile tee system constructed in accordance with the principles of the present invention.

FIG. 2 is an end view of the system taken along line 2-2 of FIG. 1.

FIG. 3 is a side view of the system taken along line 3-3 of FIG. 2.

FIG. 4 is an enlarged plan view of the central section of the system shown in FIG. 1.

The same reference numerals refer to the same parts throughout the various Figures.

DESCRIPTION OF THE PREFERRED EMBODIMENT

Figure 5:
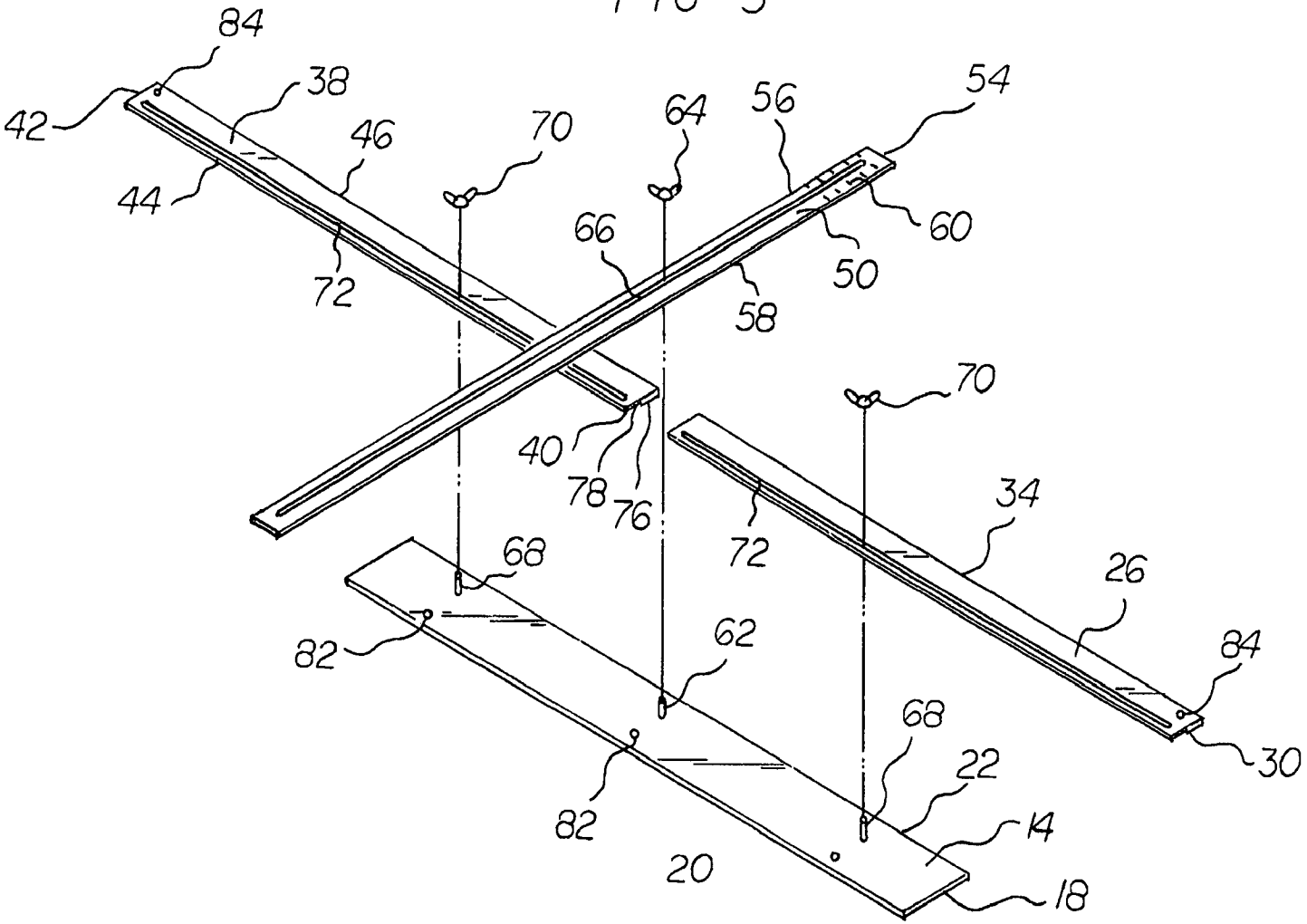
FIG. 5 is an exploded perspective view of the system shown in the prior Figures.

With reference now to the drawings, and in particular to FIG. 1 thereof, the preferred embodiment of the new and improved tile tee system embodying the principles and concepts of the present invention and generally designated by the reference numeral 10 will be described.

The present invention, the tile tee system 10 is comprised of a plurality of components. Such components in their broadest context include a substrate, first and second setting slides, a measuring slide and couplers. Such components are individually configured and correlated with respect to each other so as to attain the desired objective.

First provided is a substrate 14. The substrate is in a rectilinear configuration. The substrate has front and rear faces. The substrate has short first and second end edges 16, 18. The substrate has long side edges 20, 22. The long side edges are provided between the end edges. The side edges include an interior side edge 20 and an exterior side edge 22.

A first setting slide 26 is provided. The first setting slide is in a rectilinear configuration. The first setting slide has front and rear faces. The first setting slide has short end edges 28, 30. The first setting slide has long side edges 32, 34. The long side edges are provided between the end edges. The side edges include an interior side edge 32 and an exterior side edge 34. The end edges include an interior end edge 28 and an exterior end edge 30.

A second setting slide 38 is provided. The second setting slide is in a rectilinear configuration. The second setting slide has front and rear faces. The second setting slide has short end edges 40, 42. The second setting slide has long side edges 44, 46. The long side edges are provided between the end edges. The side edges include an interior side edge 44 and an exterior side edge 46. The end edges include an interior end edge 40 and an exterior end edge 42.

A measuring slide 50 is provided. The measuring slide is in a rectilinear configuration. The measuring slide has front and rear faces. The measuring slide has short first and second end edges 52, 54. The measuring slide has long side edges 56, 58. The long side edges are provided between the end edges. The measuring slide has a length of 48 inches. Indicia markings 60 are provided on the front face adjacent to both side edges.

Provided next are primary couplers. The primary couplers adjustably interconnect the measuring slide to the substrate. The side edges of the measuring slide are provided parallel with the end edges of the substrate. The primary couplers include one central bolt 62. The central bolt is secured to, and extends upwardly from, the front face of the substrate. An associated central wing nut 64 is provided. The central bolt is equally spaced from the end edges of the substrate adjacent to the exterior side edge. The primary couplers also include a primary slot 66. The primary slot is provided in the measuring slide. The primary slot is provided parallel with, and equally spaced from, the side edges of the measuring slide. The primary slot extends between locations adjacent to the end edges of the measuring slide. The primary bolt is adapted to receive the primary slot. The rear face of the measuring slide is provided in contact with the front face of the substrate. The wing nut on the central bolt secures the measuring slide in position.

Secondary couplers are provided. The secondary couplers adjustably interconnect the two setting slides to the substrate. The side edges of the setting slides are provided parallel with the side edges of the substrate. The secondary couplers include two end bolts 68. The end bolts are secured to, and extend upwardly from, the front face of the substrate. An associated end wing nut 70 is provided. The end bolts are equally spaced from the end edges of the substrate adjacent to the exterior edge. The secondary couplers also include a secondary slot 72. The secondary slot is provided in each setting slide. The secondary slot is provided parallel with the side edges of the measuring slide and adjacent to its interior side edge. Each secondary slot extends between locations adjacent to its end edges of its setting slide. Each secondary bolt is adapted to receive a secondary slot. The rear face of each setting slide is provided in contact with the front face of the substrate. The wing nuts on the end bolts secure the setting slides in position. The interior end edges of the setting slides are provided in contact with the side edges of the measuring slide.

Further provided is an abutment shoulder 76. The abutment shoulder is provided on the back face of each setting slide beneath the exterior side edge. In this manner a planar surface 78 is provided. The planar surface is provided in sliding contact with the exterior side edge of the substrate. Further in this manner sliding of the back faces of the setting slides on the front face of the substrate is facilitated.

Provided last are edge apertures 82. The edge apertures are provided through substrate adjacent to the interior edge and offset from the bolts. End apertures 84 are provided. The end apertures are provided through the setting slides adjacent to the exterior edges in proximity to the exterior edges. The apertures are adapted to assist a user in supporting the substrate and setting slides and the measuring slide when positioning tiles on a vertical recipient surface.

The tile tee system, according to the present invention, is a fast and easy way to install ceramic floor tile. It can also be used for walls, with or without spacers. The tile tee can go from 4 feet to 11½ feet wide. The tile tee is a fast and easy way to install ceramic floor tile with or without spacers. It consists of four moving parts, the measure slide, two setting slides, and the substrate.

The tile tee will save hours or even days on your install time, not to mention your back or knees.

The tile tee works on a 90 degree or 45 degree. Plus, it is great for custom work and layouts.

Step I

1. The recipient surface should be scraped and cleaned. Check for high and low spots. If sharp high spots are located, sand down with a hand stone.

2. Cut all door jambs with jamb cutter or use a hand saw on top of a piece of tile you are using.

3. Measure the room width and length. Then chalk down the middle of the width with a horizontal line then the middle of the length with a vertical line.

4. Use the 3-4-5 system to square out the room, measure 4 feet from the middle of the line right, then measure off from the middle on the bottom. Then use your tape measure to measure across 5 ft across should be on the money.

Tip: Measure length 3 section front/middle back.

Grout line/⅛ layout

Tile 12 inch

Grout ⅛ inch

11⅛ inch

Step II

5. Install tile tee with the right edge of the measuring slide along the vertical line and the top edge of the right setting slide, 12⅛ inch beneath the horizontal line. Then install 6 tiles to the right of the vertical line and beneath the horizontal line.

6. Then slide back the measure slide back and install an additional 6 tiles to the left of the previously installed 6 tiles.

Tip: Put water bucket on slide or mud bucket to keep stable until tile is set in.

Step III

7. Set up tile tee with the top edge of the setting slide 36⅜ inch beneath the first row of tiles, then mud in a 3×3 set of tile, called a rack, above the right setting slide.

8. Make sure you measure from the vertical line to the end of the six tiles you already laid. So you can slide out the setting slide out to that measurement. Then, set another rack of nine tiles on the right. Pull back the measuring slide and set the left side the same way two racks.

Tip: Measure the first three tiles, then mark the setting slide when you pull out the setting slide, the mark should be right at the 72⅝ inch mark.

9. Spread out the setting slides to the 72⅝ inch mark and then fill the rack.

10. When you spread out the setting slide to the 72-6/8 mark, mark the recipient surface then you will know where to slide out the setting slide.

11. Start over.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tile tee system comprising:

a substrate having front and rear faces, short first and second end edges and long side edges with interior and exterior side edges;

first and second setting slides having front and rear faces, short end edges and long side edges with interior and exterior side edges;

a measuring slide having front and rear faces, short first and second end edges and long side edges; and couplers for adjustably interconnecting the measuring slide to the substrate with the side edges of the measuring slide parallel with the end edges of the substrate and for adjustably interconnecting the two setting slides to the substrate with the side edges of the setting slides parallel with the side edges of the substrate.

2. The system as set forth in claim 1 and further including indicia markings on the front face of the measuring slide adjacent to the side edges for measuring purposes.

3. The system as set forth in claim 1 wherein the couplers include primary couplers for adjustably interconnecting the measuring slide to the substrate with the side edges of the measuring slide parallel with the end edges of the substrate, the primary couplers including one central bolt secured to, and extending upwardly from, the front face of the substrate with an associated central wing nut, the central bolt being equally spaced from the end edges of the substrate adjacent to the exterior side edge, the primary couplers also including a primary slot in the measuring slide parallel with, and equally spaced from, the side edges of the measuring slide, the primary slot extending between locations adjacent to the end edges of the measuring slide, the primary bolt adapted to receive the primary slot with the rear face of the measuring slide in contact with the front face of the substrate and with the wing nut on the central bolt for securing the measuring slide in position the couplers also including secondary couplers for adjustably interconnecting the two setting slides to the substrate with the side edges of the setting slides parallel with the side edges of the substrate, the secondary couplers including two end bolts secured to, and extending upwardly from, the front face of the substrate with associated end wing nut, the end bolts being equally spaced from the end edges of the substrate adjacent to the exterior edge, the secondary couplers also including a secondary slot in each setting slide parallel with the side edges of the measuring slide and adjacent to its interior side edge, each secondary slot extending between locations adjacent to its end edges of its setting slide, each secondary bolt adapted to receive a secondary slot with the rear face of each setting slide in contact with the front face of the substrate and with the wing nuts on the end bolts for securing the setting slides in position with the interior end edges of the setting slides in contact with the side edges of the measuring slide.

4. The system as set forth in claim 1 and further including:

an abutment shoulder on the back face of each setting slide beneath the exterior side edge to provide a planar surface in sliding contact with the exterior side edge of the substrate to facilitate sliding of the back faces of the setting slides on the front face of the substrate.

5. The system as set forth in claim 1 and further including:

edge apertures through substrate adjacent to the interior edge and offset from the bolts and end apertures through the setting slides adjacent to the exterior edges in proximity to the exterior edges, the apertures adapted to assist a user in supporting the substrate and setting slides and the measuring slide when positioning tiles on a vertical recipient surface.

6. A tile tee system for assisting craftsmen in the proper placement of tiles in linear alignment on a recipient surface in an accurate, rapid and economical manner, the system comprising, in combination:

a substrate in a rectilinear configuration having front and rear faces, the substrate having short first and second end edges and long side edges between the end edges, the side edges including an interior side edge and an exterior side edge;

a first setting slide in a rectilinear configuration having front and rear faces, the first setting slide having short end edges and long side edges between the end edges, the side edges including an interior side edge and an exterior side edge, the end edges including an interior end edge and an exterior end edge;

a second setting slide in a rectilinear configuration having front and rear faces, the second setting slide having short end edges and long side edges between the end edges, the side edges including an interior side edge and an exterior side edge, the end edges including an interior end edge and an exterior end edge;

a measuring slide in a rectilinear configuration having front and rear faces, the measuring slide having short first and second end edges and long side edges between the end edges, the measuring slide having a length of inches with indicia markings on the front face adjacent to both side edges;

primary couplers for adjustably interconnecting the measuring slide to the substrate with the side edges of the measuring slide parallel with the end edges of the substrate, the primary couplers including one central bolt secured to, and extending upwardly from, the front face of the substrate with an associated central wing nut, the central bolt being equally spaced from the end edges of the substrate adjacent to the exterior side edge, the primary couplers also including a primary slot in the measuring slide parallel with, and equally spaced from, the side edges of the measuring slide, the primary slot extending between locations adjacent to the end edges of the measuring slide, the primary bolt adapted to receive the primary slot with the rear face of the measuring slide in contact with the front face of the substrate and with the wing nut on the central bolt for securing the measuring slide in position;

secondary couplers for adjustably interconnecting the two setting slides to the substrate with the side edges of the setting slides parallel with the side edges of the substrate, the secondary couplers including two end bolts secured to, and extending upwardly from, the front face of the substrate with associated end wing nut, the end bolts being equally spaced from the end edges of the substrate adjacent to the exterior edge, the secondary couplers also including a secondary slot in each setting slide parallel with the side edges of the measuring slide and adjacent to its interior side edge, each secondary slot extending between locations adjacent to its end edges of its setting slide, each secondary bolt adapted to receive a secondary slot with the rear face of each setting slide in contact with the front face of the substrate and with the wing nuts on the end bolts for securing the setting slides in position with the interior end edges of the setting slides in contact with the side edges of the measuring slide;

an abutment shoulder on the back face of each setting slide beneath the exterior side edge to provide a planar surface in sliding contact with the exterior side edge of the substrate to facilitate sliding of the back faces of the setting slides on the front face of the substrate; and edge apertures through substrate adjacent to the interior edge and offset from the bolts and end apertures through the setting slides adjacent to the exterior edges in proximity to the exterior edges, the apertures adapted to assist a user in supporting the substrate and setting slides and the measuring slide when positioning tiles on a vertical recipient surface.

* * * * *